United States Patent [19]

Bucefari et al.

[11] Patent Number: 4,493,183

[45] Date of Patent: Jan. 15, 1985

[54] MACHINE FOR THE MANUFACTURE OF CHAINS, IN PARTICULAR OF THE TYPE KNOWN AS ROPE CHAIN IN THE GOLDSMITHERY INDUSTRY

[75] Inventors: Massimo Bucefari, Arezzo; Giuseppe Scortecci, Castiglion Fibocchi, both of Italy

[73] Assignee: ICM S.p.A. Italiana Costruzioni Metalmeccaniche, Castiglion Fibocchi, Italy

[21] Appl. No.: 422,057

[22] Filed: Sep. 23, 1982

[30] Foreign Application Priority Data

Jan. 15, 1982 [IT] Italy ..... 9307 A/82

[51] Int. Cl.[3] ..... B21L 7/00

[52] U.S. Cl. ..... 59/16; 59/20

[58] Field of Search ..... 59/16, 17, 20, 25, 10, 59/12

[56] References Cited

U.S. PATENT DOCUMENTS 4,175,379 11/1979 Tega ..... 59/16

FOREIGN PATENT DOCUMENTS 262878 7/1913 Fed. Rep. of Germany ..... 59/16

*Primary Examiner*—Francis S. Husar

*Assistant Examiner*—Linda McLaughlin

*Attorney, Agent, or Firm*—Lester Horwitz

[57] ABSTRACT

A machine for the manufacture of chains of the "rope chain" type for the goldsmithery industry, in which each link is taken from a spiral of wire by means of one or more cuts tangential to the internal profile of the winding. The cuts can be simultaneous or consecutive. The cutting unit includes a pair of blades, the cutting plane of which is adjustable with respect to horizontal so that it can be perpendicular to the coil winding to be cut; it also oscillates between two cutting positions in order to obtain separation of the link with two consecutive cuts in correspondence to two intermittent, 180° one-way rotations of the coil. For chain-linking, a calibrated passage with a decreasing section is provided, in which the take-up unit, after having united a link to those already joined, forces the chain to advance, producing closure of the links with partial overlapping of their contoured extremities.

11 Claims, 11 Drawing Figures

MACHINE FOR THE MANUFACTURE OF CHAINS, IN PARTICULAR OF THE TYPE KNOWN AS ROPE CHAIN IN THE GOLDSMITHERY INDUSTRYcl FIELD OF THE INVENTION

The present invention relates to a machine for the manufacuture of chains of precious or non-precious materials. More precisely the invention relates to a machine for the manufacuture of chains of the type called "rope chains", "French rope" or seamed link chain in the goldsmithery industry; that is, the type in which each link engages with more than one link, previously jointed to others, to form the chain, which looks like a rope.

BACKGROUND OF THE INVENTION

As is known to the persons skilled in the art, the aforementioned type of chain presents considerable production problems due to its particular linkage pattern, which requires engagement of more than one link with others with small reciprocal play. One problem is to ensure an adequate connection between links after closure, to avoid failure of the chain even under light stress. Another problem is to place the extremities of each link in the most convenient position for the subsequent soldering phase. To obtain these results the extremities of the links are shaped so as to reduce their dimensions, to permit easier mutual penetration, and to provide a greater support surface for the soldering material and thus greater strength in the finished chain. To these purposes two types of machines for automatic production of this type of chain have been proposed, as alternatives to the traditional semi-manual methods.

A first type of these machines consists of two distinct, separate units, one for producing the link and the other for assembling the chain. A coil of filiform material is formed (generally a closed coil; that is, one in which the single turns are in contact with each other) and the single links are separated from the coil by milling with a milling-tool operating under the coil and tangentially to it to produce symmetrical, substantially nail-shaped extremities of each link. With the aid of vibration feeders or other suitable systems, the links thus formed are fed to a conventional linking machine equipped with pincers for engaging the links one to the others and for closing them.

A second type of machine for the manufacture of rope chain type chains operates by shearing off straight pieces of filiform material of suitable length with a punch so shaped as to obtain at the same time the desired contouring of the extremities of the piece cut. The piece is then taken up by internally-grooved pliers and forced against a transversal pin to obtain an open ring thus forming an open link with opposed, contoured extremities, housed in the groove of the pliers. The link is then joined in traditional manner to the already connected links, and closed over them to form the chain.

The chains produced with the machines described above, despite the shape of the extremities of the links, do not possess satisfactory strength and therefore they tend to come apart before soldering; this is due also to some springback in the material itself. To reduce this risk, the chains are frequently subjected to a final hammering which inevitably leaves tool marks, sometimes quite visible, on the surface of the links.

In practice, due to the structure of the chain, it is not possible to obtain, by means of pliers, link closure for a secure connection, even when the extremities are very sharply shaped, as obtained with the first type of the above described machine. The pliers, due to their very dimensions, cannot grip the link more than a certain amount without interfering with the other, neighboring links or with the pincers that support the already-formed length of chain. It is clear that, the smaller the links to be closed, the greater is the inconvenience.

On the other hand, it is evident that is not possible to reduce the lateral ribs of the pliers, in order to render them less bulky, below a certain limit without jeopardizing their strength.

In the case of links produced with the second type of machine, a less sharp shape of their ends is obtained and, moreover, the ends of the links are symmetrically opposed (the ends of the links obtainable by means of the first type of machine, being taken from a coil, are staggered one with respect to the other). This makes it impossible to completely close the link even after hammering and, moreover, provides only a very small useful surface for soldering: thus, even after this operation, the strength of the chain is relatively low.

The first type of machine as hereinbefore described permits obtaining a shape of the extremities of the links better suited for closure than those obtainable by shearing but this machine is, on the other hand, much more complicated mechanically, because it is composed of two separate operative units connected by intermediate link transport means. Finally, the problem of recovery of the material removed as dust by the milling tool, cannot be ignored. Dust recovery is essential in goldsmithery for economic reasons and anyway for health reasons in the working environment, where non-precious material are handled. Suitable aspiration and transport devices for collection and recovery of the aforementioned dusts must therefore be installed.

SUMMARY OF THE INVENTION

A machine for the manufacture of chains, in particular those of the type called "rope chain" in the goldsmithery industry, which eliminates the aforementioned inconveniences presented by known machines, has now been designed and is the object of the present invention.

One of the fundamental characteristics of the machine according to the present invention consists in the fact that the link is formed from a turn of an open coil of filiform material by direct cutting with blades operating like scissors on a plane perpendicular to that of the coil turn. To be cut; the blades are, to this end, mounted on a support, the inclination of which can be adjusted with respect to the horizontal plane according to the inclination of the coil, in order to obtain a cutting section perpendicular to the circumferenctial axis of the turn. In particular, the separation of a turn from the coil can be obtained with a single cut made by a single pair of blades, or by two facing pairs of blades, after a complete revolution of the coil, or with two consecutive cuts made by a single pair of blades, in correspondence to two sequential 180° rotations of the coil and a simultaneous vertical, alternating angular displacement of said pair of blades. The operating plane of the blades is substantially tangent to the inner circumferential profile of the coil turn to be cut, so that, for every turn separated from the coil, a small residual piece of material is also produced. As will be explained below, when using a single pair of blades and two consecutive cuts the link ends are shaped in a particularly advantageous way for the following linking phase. The use of scissors blades for the separation of links suitable for the production of rope chains solves the problems encountered in this phase of work with known machines and in particular, in view of the fact that the cutting plane is always perpendicular to the coil turn to be cut, the presence of radial cut components, which inevitably tend to displace the coil from its correct position, is eliminated.

Another important feature of the machine according to the present invention is the fact that closure of the links of the chain, once connected according to the pre-selected pattern, is carried out by means of a process which is substantially similar to a drawing process, since the chain is forced to pass through a calibrated passage with a progressively decreasing section and, if it is preferred with an internally shaped wall. In the machine according to the invention, link take-up means are provided for keeping the open link, once it is separated from the coil of wire, and for transferring it to a chain linking unit where said calibrated passage is provided. Link take-up means, after connection of the link to the already formed chain, while advancing toward said passage and simultantenously rotating around the axis thereof, pushes the chain into the passage, giving a helicoidal advancing motion to the chain. In this way the nail-shaped ends of the links are partially overlapped by the force exerted by the wall of the passage against the links, thus avoiding any damage to the chain and being especially advantageous for the subsequent soldering phase. According to the present invention, there is provided a machine for the manufacture of chains, in particular of the the type known as "rope chain" in the goldsmithery industry, which comprises: a unit for feeding a metallic filiform material and for the formation of a coil from said material, each turn of said coil constituting a link for the chain; a link separation unit for cutting off coil turns from said coil: a chain linking unit for connecting said link to already formed chain; link take-up means alternatively cooperating with said link separation unit for keeping the link, and with said chain linking unit, said means being displaceable from a take-up position to a linking position and vice versa. The machine is characterized by the fact that the link separation unit comprises at least a pair of blades operating like scissors on a cutting plane substantially tangent to the internal profile of the coil and perpendicular to the branch of coil turn to be cut, means being provided for adjusting the inclination of said cutting plane with respect to the horizontal plane. The machine is further characterized by the fact that the chain linking unit comprises a calibrated passage having a decreasing section with a minimum diameter at the end of said passage substantially equal to the diameter of the chain to produced, said chain being kept within said passage by the pressure of the links against the inner wall thereof. Finally, said link take-up means can be aligned with said chain linking unit for connecting the link to the already formed chain and is adapted to partially rotate around the alignment axis while simultaneously advancing toward said passage so as to force the chain to pass therethrough, thereby causing the progressive approach of the ends of the links until said links are completely closed.

BRIEF DESCRIPTION OF THE DRAWINGS

The characteristics, as well as the advantages, of the machine for the manufacture of chains as described in the present invention will be clearer from the following description of a preferred embodiment of the machine, described by way of example but in no way limiting, with reference to the accompanying drawings, in which.

DETAILED DESCRIPTION OF THE PREFERRED EMBODIMENT

Figure 1:
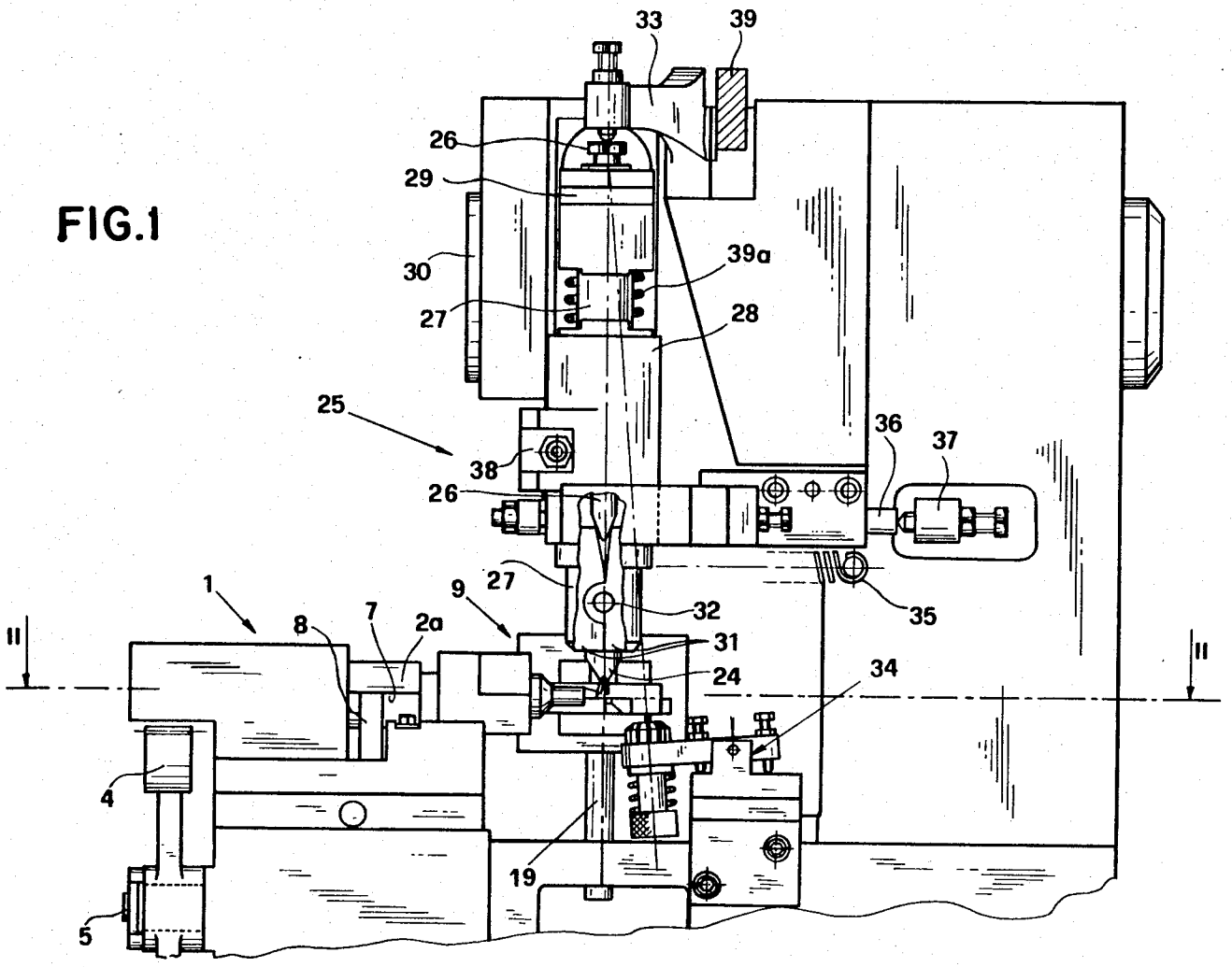
FIG. 1 is a front view of the machine according to the invention, parts being in section and parts removed for simplicity of illustration.
Figure 2:
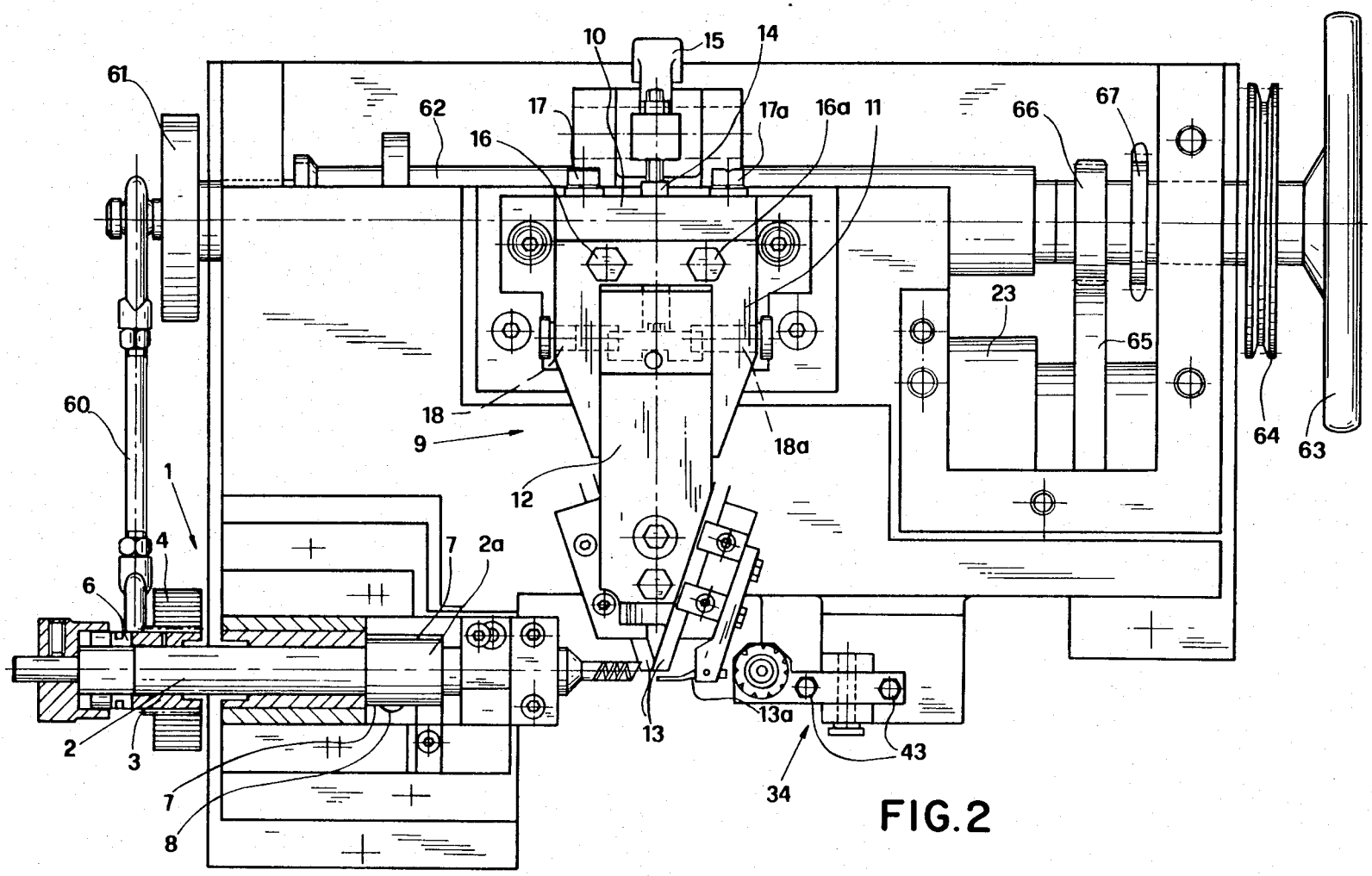
FIG. 2 is a top plan view of the same machine, when sectioned along the section line II—II of FIG. 1.
Figure 8:
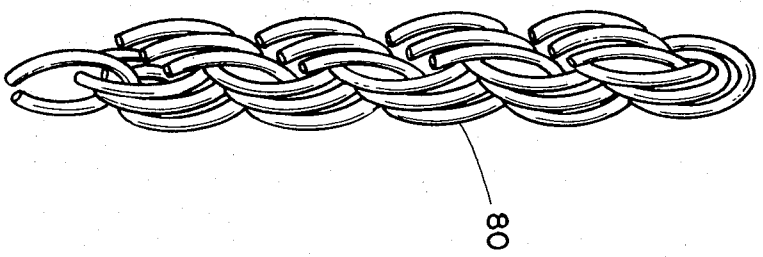
FIG. 8 shows an example of "rope chain" manufactured by the machine according to the invention.

With reference to FIGS. 1 and 2, 1 generally indicates a unit for feeding metallic, filiform material, in particular precious metal wire, and for the formation of a coil from it. The unit 1 is of the conventional type and normally used with known machines for the production of precious chains; the chain links are obtained as turns of a coil of precious wire, means being provided for intermittently rotating said coil, while feeding it towards a link separation unit. As is well-known to those skilled in the art, the wire of precious material (coming from a reel, not shown, on which it is wound) is frictionally dragged forward and bent to form a coil 80 as shown in FIG. 8 by means of the end portion of a rotating shaft 2.

Thus the wire is forced to progressively wind around said end portion of shaft 2. For this purpose, an idle pinion 3 is provided on shaft 2 engaging with a sector gear 4 oscillating with respect to a fulcrum 5 due to the action of a connecting rod 60 eccentrically connected to a disk 61 keyed to one end of a main drive shaft 62 of the machine, at the other end of which a handwheel 63 for manual operation and a pulley 64 for connection to a suitable electric motor, not shown, are mounted.

A front tooth clutch member 6 with helical shaped front profile, integral with shaft 2 is urged against a correspondingly shaped face of pinion 3 in order to slide towards and away from pinion 3 along shaft 2 so as to engage and disengage pinion 3 with sector gear 4, in coincidence with its forward movement and, respectively, during its backward movement. In order to avoid reverse motion of shaft 2 due to possible drag during the backward movement of sector gear 4, a pair of 180° -spaced longitudinal ledges 7 are formed on an intermediate surface portion 2*a* of shaft 2 alternatively cooperating with a tappet 8 actuated by cam and lever means not shown. When sector gear 4 moves backward, the head of tappet 8 is urged against one of ledges 7, thus avoiding reverse rotation of shaft 2; whilst it is moved away from surface 2*a* by said cam and lever means, to allow the rotation of shaft 2 in the proper direction, until the second ledge 7 is encountered. In the present embodiment of the invention, therefore, a complete rotation of shaft 2 is performed in two successive 180° rotation spaced by two corresponding phases during which shaft 2 is stopped. Since the amplitude of oscilating motion of sector gear 4 is selected in such a way that a complete oscillation of sector gear 4 corresponds to an alternating 180° rotation of pinion 3, engaged with clutch member 6 in one direction and disengaged from it in the other, in conclusion two complete oscillations of sector gear 4 correspond to one 360° rotation of shaft 2.

Figure 3:
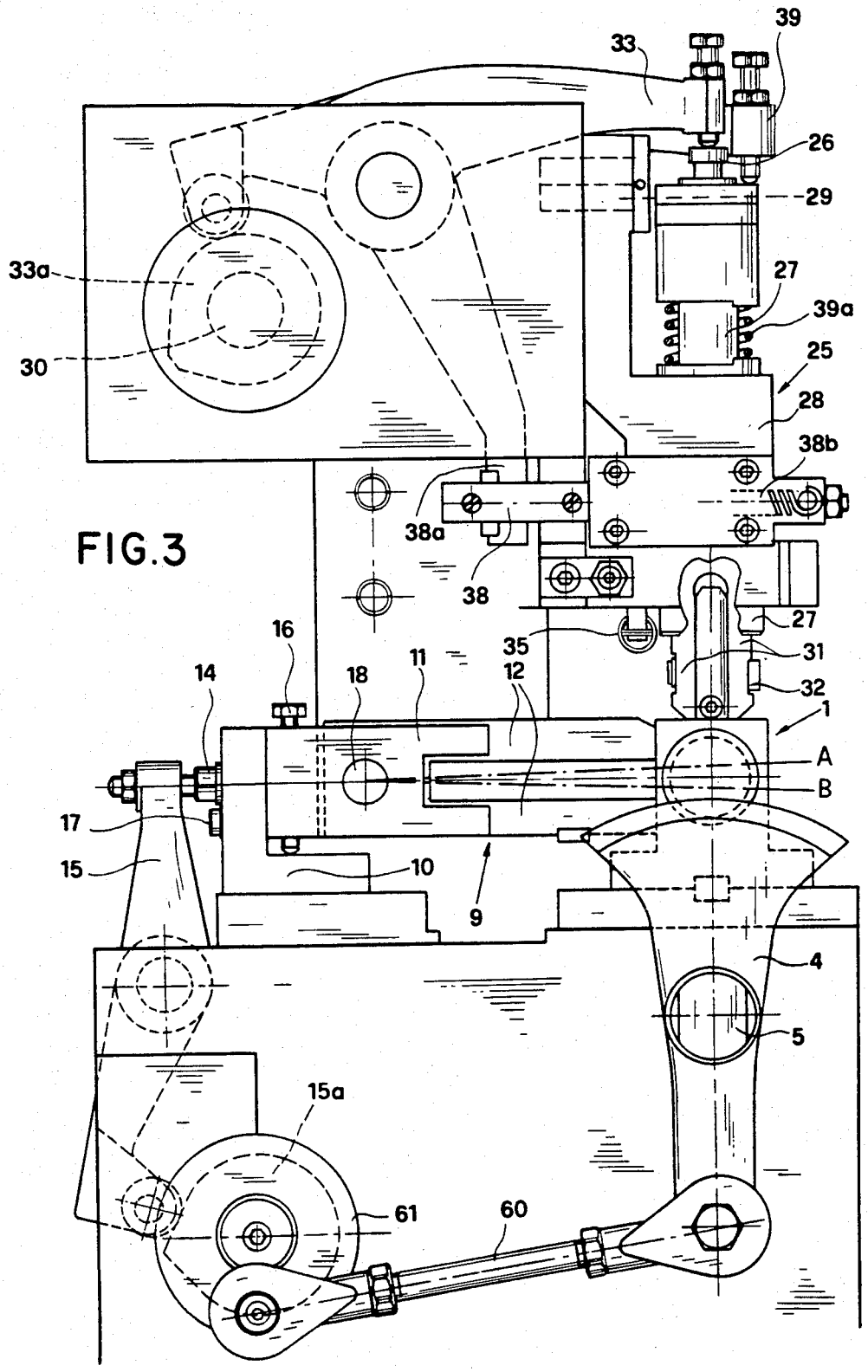
FIG. 3 is a side elevation of the same machine.
Figure 4:
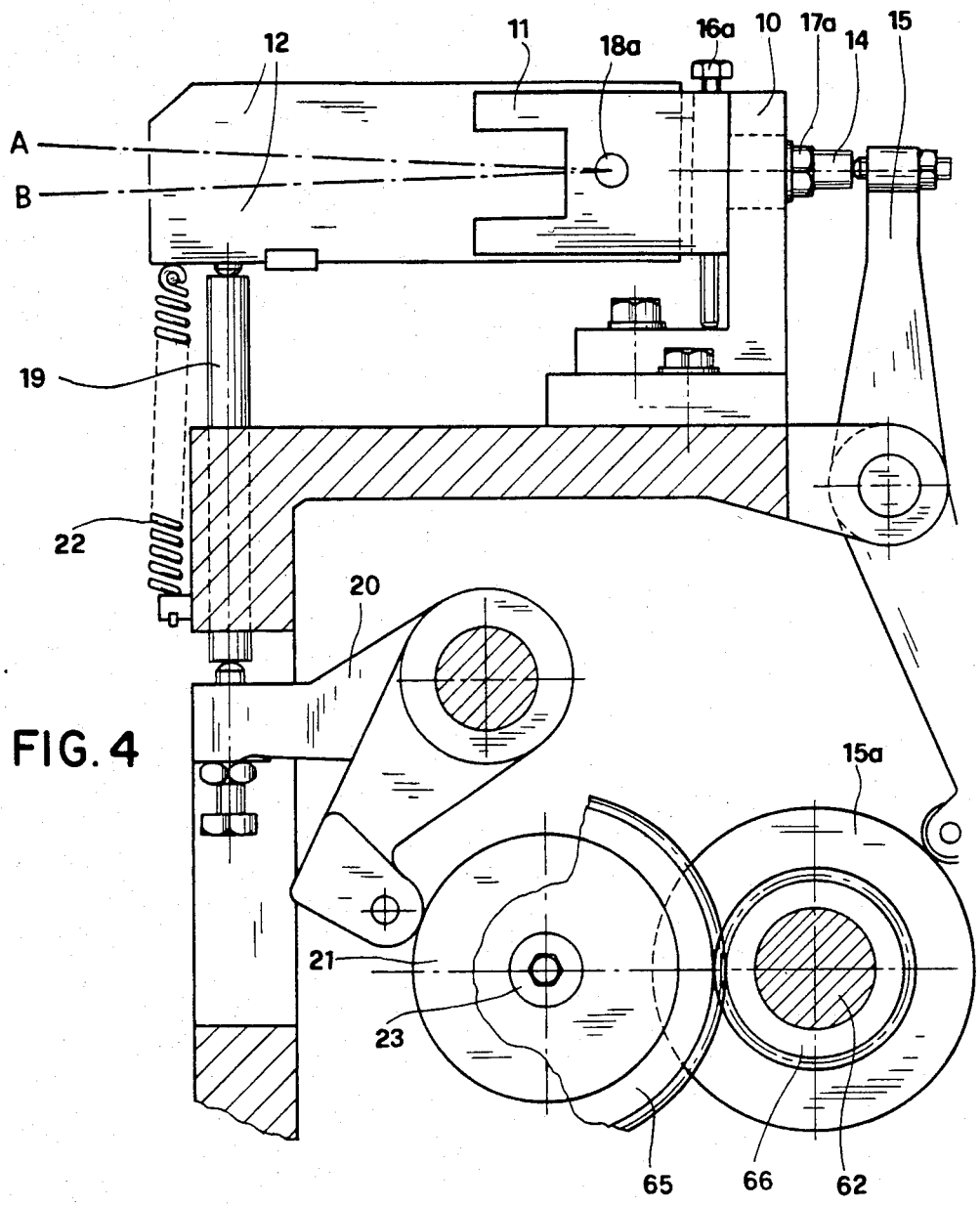
FIG. 4 is an enlarged side view of the means for oscillating the link-separation unit.
Figure 5A:
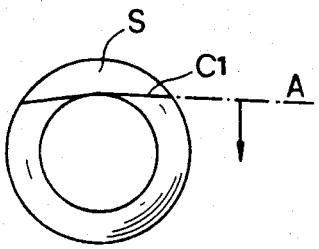
FIG. 5*a* and FIG. 5*b* illustrate two successive phases of the separation of a link from the coil in front view.
Figure 5B:
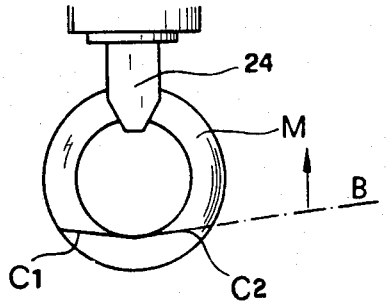
Figure 7A:
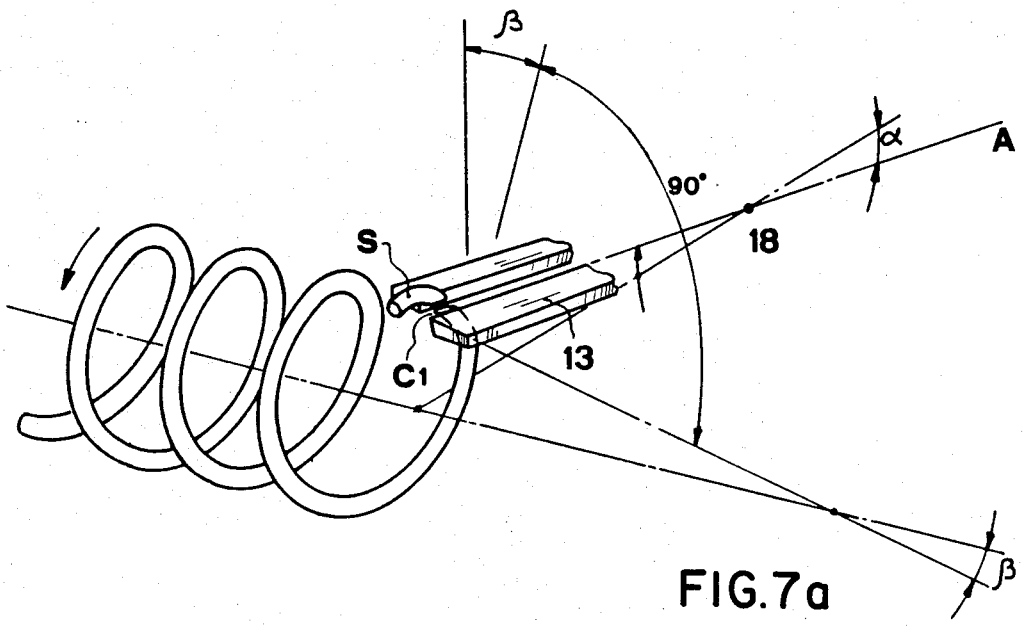
FIG. 7*a*, and FIG. 7*b* respectively, are schematic perspective views of the two phases of link separation shown in FIGS. 5*a* and 5*b*.
Figure 7B:
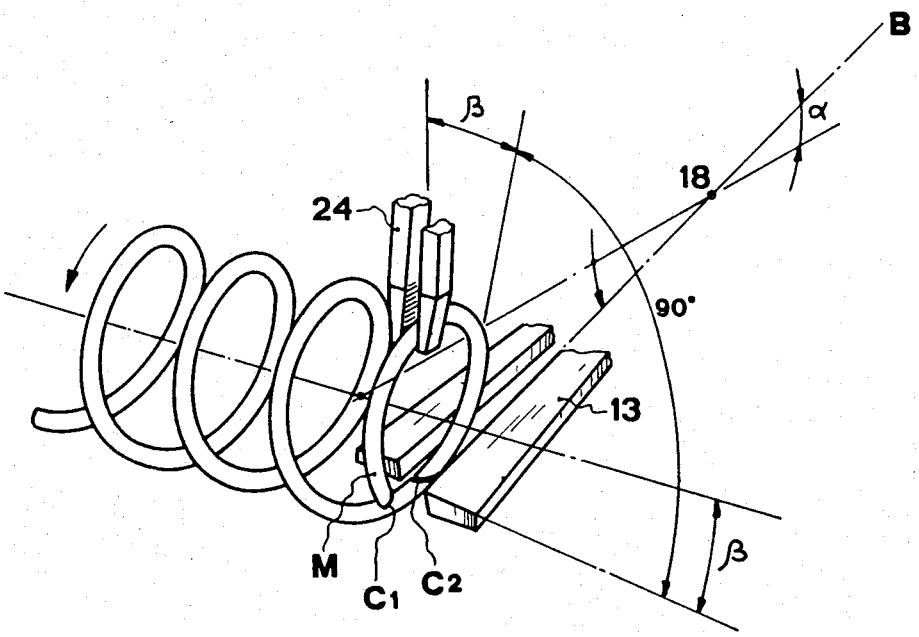

In FIG. 1 a unit for the separation of the links from the coil is generally indicated at 9: the unit is shown in more detail in FIGS. 2 and 3. With particular reference to these figures, unit 9 comprises a fixed L-shaped support 10 supporting a horizontal fork 11 to which an arm 12 is pivotally connected by transverse pins 18 and 18*a*. Arm 12 projects from fork 11 and carries at its free end a pair of blades 13 operating like scissors to cut off single turns of the coil coming from unit 1. Blades 13 are operated in a known way by means of an articulated tappet 14 sliding within arm 12 to open and close the blade supports and actuated by a lever 15 and cam 15*a* keyed on main shaft 62. According to the invention setting screws 16 and 16*a* are provided for adjusting the inclination of fork 11 with respect to L-shaped support 10, by screwing them for a different length, when the machine set-up is carried out before its operating start-up. Rear screws 17 and 17*a* are provided for securing fork 11 to the fixed support 10, after fork 11 has been adjusted in the required operating position. The operating plane of blades 13 is therefore correspondingly inclined with respect to the horizontal plane defined by the longitudinal axis of coil and oscillating axis of pins 18 and 18*a*. The inclination of said operating plane is chosen in such a way that said plane is perpendicular to the branch of coil turn at the point where the cut has to be made. Means for oscillating arm 12 around transverse pins 18 and 18*a* are furthermore provided. Arm 12 is vertically displaced between a first and second angularly spaced operating position shown by dotted lines A and B in FIGS. 4, 5 and 7, respectively. As shown in FIGS. 1 and 4, the angular displacement of arm 12, the amplitude of which is substantially equal to the internal diameter of the coil, is obtained by means of a vertical tappet 19 and a counteracting return spring 22 both operating, on the underside of arm 12; tappet 19 being actuated by a lever 29 cooperating with a cam 21 carried by a shaft 23. Shaft 23 is rotated by main shaft 62 throught a gear transmission, consisting of pinion 65 equal to 0.5; therefore the speed of rotation of shaft 23 is half of the speed of rotation of main shaft 62. In this way cutting operation and coil advancement are properly syncronized. In fact, while blades 13 are being displaced from the first to the second operating position and vice versa with a coil turn branch arranged therebetween, a simultaneous 180° rotation is imparted to the coil. As shown in FIGS. 5*a, b* and 7*a, b* (where equal reference greek letters relates to equal angles) each link, constituted by a turn of coil, is cut off from the coil not in motion by two consecutive cuts when blades 13 reach the first operating position A and the second operating position B respectively. More particularly, when the blades are in the first operating position A, the first cut produces the section C1 on the coil turn and a small piece of reject material S, which is removed and recovered. The cut has to be made sustantially tangent to the inner profile of the coil to have the minumum amount of reject material S and, at the same time, to produce an open link, in order to allow the connection with the already formed chain. Then blades 13 are displaced to the second operating position B, while coil is rotated around its own axis of an angle of 180° in the opposite direction with respect to the downward displacement of blades operating plane. When blades reach the position B and simultaneously the 180° rotation of the coil is completed, the second cut is executed producing the section C2 and separating a link M from the coil. The operating cycle is then repeated with a new 180° rotation of the coil and a simultaneous upward displacement of blades 13 to the position A. Since the ends of the link as cut off from the coil would be too spaced apart from one another with respect to the mean plane of the link itself, due the inclination of the coil, a device for displacing said ends is provided in the form of a prod 13*a* secured to the mobile support member of one of the blades 13 and acting in a direction parallel to the longitudinal axis of the coil against the end of the link M corresponding to section C1, while blades cut section C2 of the link.

It should be noted that, in view of the angles formed by the above described first and second operating positions A and B with the horizontal plane as defined above, the resulting nail-shaped ends of the like converge with their points outward with respect to the centre of the link itself. This configuration is particularly advantageous when carrying out the further chain linking and link closing phases, since an appreciable reduction of material has been obtained, in correspondence to these ends, thereby making easier the mutual engagement of the links.

Of course, to prevent the link from falling down after the second cut has been executed, pincers 24, operating on a vertical plane above the coil turn to be cut off, are provided to hold it in position. Pincer 24 is part of link take-up means, generally indicated at 25 in FIGS. 1 and 3, substantially of the conventional type. Link take-up means 25 comprises tappet 26 slidably mounted inside a shaft 27, which, in turn, slides and rotates within a support block 28 mounted for oscillatory movement on a horizontal pivot 29 secured to the main frame of the machine. Pincers 24 are opened and closed by the vertical sliding of tappet 26 in a known way. The sliding movement of tappet 26 and of shaft 27 as well as the rotation of shaft 27 and the pivotal movement of support block 28 on horizontal pivot 29 are transmitted by lever means cooperating with counteracting return spring means, said lever means being actuated by corresponding cams carried by a secondary shaft 30 connected for rotation to main drive shaft 62 by means of common gear and chain transmission means (only a drive gear 67 of main shaft 62 is shown in FIG. 2). The speed of rotation of secondary shaft 30 is equal to half of that of main shaft 62, in order to obtain the necessary syncronization between link take-up unit 25, wire feeding and coil forming unit 1 and link separation unit 9. More particularly the above movements are obtained in the following way. Tappet 26, which actuates pincer arms 31 pivoting on a pin 32 fixed to shaft 27, is slid vertically inside shaft 27 by a lever 33 actuated by a cam 33*a* of shaft 30. The rotation of link take-up means 25 around horizontal pivot 29, to bring pincers 24 in cooperating alignment (as explained later on) with a chain linking unit, generally indicated at 34 in FIG. 1, is obtained by the action of a spring 35, while the return to the vertical position for cooperating alignment with link separation unit is obtained by the action of a tappet 36, acting on support block 28 in opposition to spring 35.

Tappet 36 is moved by a lever head 37 actuated by a cam (not shown) of shaft 30. To rotate shaft 27 on its own axis a rack 38 is provided for engaging with a corresponding toothed portion formed on shaft 27 (and not shown in the figures as covered by the rack itself.) Rack 38 is intermittently reciprocated by a lever 38*a* (FIG. 3) actuated by a cam (not shown) of shaft 30 and by a counteracting return spring 38*b*. Axial movement of shaft 27 is finally controlled by a lever 39, actuated by a cam (not shown) integral with shaft 30, and by a counteracting return spring 39*a*. The operation of link take-up unit 25 will be explained later.

Figure 6A:
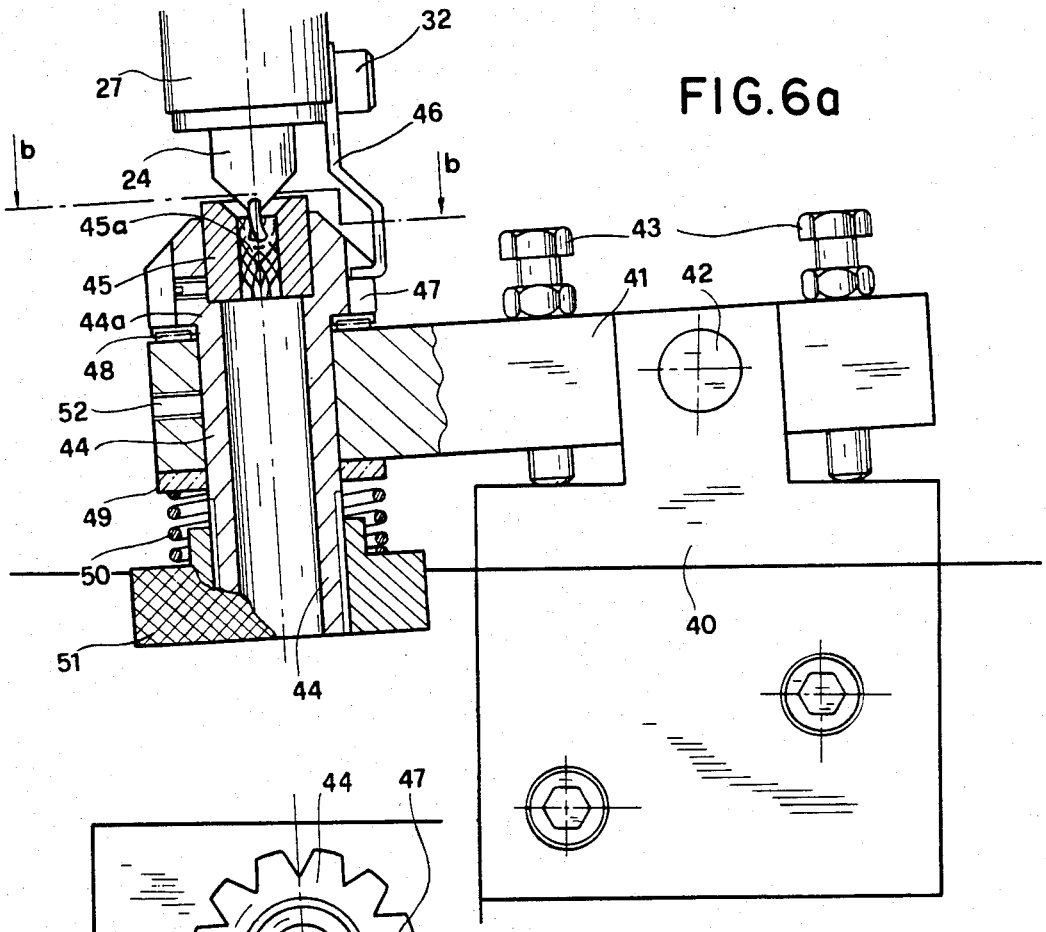
FIG. 6*a* and FIG. 6*b* illustrate the linking station in detail, in side section and in partial plan view, respectively, FIG. 6*b* being taken along line 6*b*—6*b* of FIG. 6*a*.
Figure 6B:
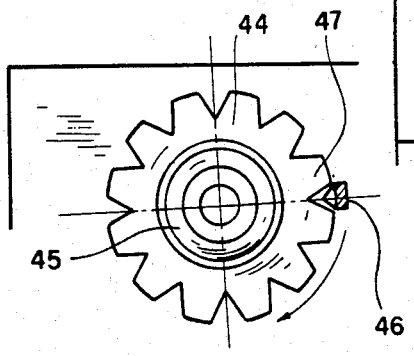

Chain linking unit 34 is generally shown in FIG. 1 and in more detail in FIG. 6*a, b* where it has been illustrated in cooperative alignment with link take-up unit 25. Chain linking unit 34 comprises a substantially upside-down reversed T-shaped support 40, fixed with respect to the frame of the machine, and a bracket 41 pivotally connected to support 40 by means of a horizontal pivot 42. Two adjustment screws 43 engaging bracket 41 to both side of pivot 42 are provided for adjusting the inclination of bracket 41. A projecting end of bracket 41 holds in a perpendicular relation, a substantially vertical hollow shaft 44, adapted to firmly house a tubular element 45 coaxial to hollow shaft 44 and having a calibrated section. The internal section of tubular element 45 progressively downwardly decreases the minimum diameter being essentially equal to the final diameter of the chain.

The operation of link take-up unit 25 in cooperation with the link separation unit 9 and with the chain linking unit 34 is as follows. Just before blades 13 execute the second cut to separate a turn from the coil of precious material, shaft 27 of link take-up unit 25, which is vertically above the coil turn to be cut off as shown in FIG. 1, is slid downward and arms 31 of pincer 24 are actuated to catch the turn and hold it after it has been cut off. Then unit 25 is rotated on pivot 29 to such an angle as to align with the axis of tubular element 45 of chain linking unit 34 (as shown in FIG. 6*a*). Further downward sliding of shaft 27 provides connection of the link just cut off to previously connected links, according to the linking pattern of the chain, which is held within tubular element 45. The movement of shaft 27 towards tubular element 45 forces the chain to pass through it; therefore, due to the decreasing section of said element 45, the links of the chain are forced against the inner wall of the tubular element 34, causing their shaped ends to progressively approach until they are completely closed, also resulting in a partial overlapping of the points of the link ends. The final phase of this downward sliding of the shaft 28 is simultaneous to a partial rotation of shaft 27 itself around its own axis to place the last connected link in the proper position for a further link connection. Finally, pincers 24 release the link and the link take-up unit 25 is displaced back over the link separation unit, where, in the meantime, the first cut on a new coil turn has been executed. The chain is held in the linking position by tubular element 45 itself due to the links' springback against the inner wall thereof.

In order to avoid deformation of the chain due to the axial rotation of link take-up unit 25 (this is, in particular, the case when the links are made of very fine wire), shaft 44 is adapted to rotate integrally with shaft 27 of unit 25.

To this end, head 44*a* of shaft 44 is externally provided with equally spaced axial grooves 47 and a trailing hook 46, fixed to shaft 27, extends from it for engaging within one of said grooves 47 when link take-up unit 25 comes into cooperating alignment with chain linking unit 34. Axial roller bearing 48 is placed between bracket 41 and head 44*a* to allow rotation of said head 44*a* when hook 46 engages with groove 47, while, to avoid undue rotation of shaft 44 when hook 46 is disengaged, a friction ring 49, integral with shaft 44, is urged against bracket 41 by a coaxial spring 50 which is maintained under proper compression by means of an adjustment knob 51 engaged on a threaded portion formed at the end of shaft 44 opposite to head 44*a* thereof.

The number of links per unit length of chain, i.e. the length of chain corresponding to a complete turn thereof or, in other words, the pitch of the chain, obviously depends on the diameter of the chain and of the link as well as on the size and shape of the wire of which the link is made. For a proper positioning of the chain in the chain linking unit 34, link take-up means 25 are axially rotated, each time a link is connected to the chain, by an angle equal to 360° divided by the number of chains per unit length. Likewise, the number of grooves 47 of head 44*a* is equal to the same number of links, to allow consecutive engagements of hook 46 therewith. Where there is no risk of chain deformation (for instance, in case of links made of large precious wire), trailing hook 46 can be moved and head 44*a* blocked with respect to bracket 41 by means of grub screw 52.

In order to assure proper positioning of the chain in chain linking unit 34, the negative impression 45*a* of the chain to be manufactured is advantageously formed on the inner wall of tubular element 45, thus providing a channelled guide in it. Obviously tubular element 45 is easily replaceable, to allow for production of rope chains of different size and number of links per unit length.

In the present embodiment of the invention the rotation of the chain around its longitudinal axis for its proper positioning is provided by link take-up unit 25. It is clear however that, alternatively, hollow shaft 44 could be rotated (for instance, by means of rack and counteracting spring, like shaft 27, while leaving to link take-up unit 25 the functions of holding the link, transfering and connecting the links, as well as advancing the chain.

According to another embodiment of the invention, the separation of each link from the coil of precious material is obtained by means of a single cut executed by blades 13 operating like scissors on a plane substantiably tangent to the internal profile of the coil. The position of blades 13 is adjustable with respect to the inclination of the coil so as to be perpendicular to it, as described above, but the operating plane, once the inclination has been selected, is fixed during cutting operation, the cut being made on the lower part of the coil. In this case shaft 2 of feeding unit 1 will carry out one intermittent 360° rotation for each link produced. The links obtained in this way have nail-shaped ends, but no slight convergent points thereof, the section C1 and C2 lying in this case on the same plane (i.e. the operating plane of blades 13).

According to a further embodiment of the invention, the separation of each link from the coil of precious material is obtained by means of two simultaneous cuts executed by two opposed pairs of blades 13 operating as scissors on respective fixed planes substantially tangent to the internal profile of the coil. The inclination of said planes is adjustable with respect to the inclination of the relevant portion of coil where the cut has to be made, as hereinbefore described. In this case shaft 2 of feading unit 1 will also carry out intermittent 360° rotations for each link, while the ends of the links are shaped like the links obtained by using the machine according to the first embodiment of the invention. The two pair of blades will be simultaneously operated in the usual way, for instance by means of relevent levers and cams carried by the same shaft.

It is clear that the machine according to the invention is equipped with all necessary devices for adjustment and set-up of the various units as well as for assuring the coordination and synchronization of the various working phases. These devices are neither described nor shown as they are already well-known to those skilled in the art.

The invention is not to be considered as being limited by the embodiments described herein and it is understood that it encompasses any form of variation or modification falling within the scope of the claim appended hereto.

We claim:

1. A machine for the manufacture of chains, in particular of the type known as "rope chain" in the goldsmithery industry, comprising:

(a) a unit for feeding a metallic filiform material and for the formation of a coil from said material, each turn of said coil constituting a link for the chain;

(b) a link separation unit for cutting off coil turns from said coil;

(c) a chain linking unit for connecting said link to the already formed chain;

(d) link take-up means alvernatively cooperating with said link separation unit for keeping the link and with said chain linking unit, said means being displaceable from a take-up position to a linking position and viceversa;

said links separation unit comprising at least a pair of blades operating like scissors on a cutting plane substantially tangent to the internal profile of said coil and perpendicular to the branch of coil turn to be cut, means being provided for adjusting the inclination of said cutting plane with respect to the horizontal plane; said chain linking unit comprising a calibrated passage for the chain having a decreasing section with minimum diameter meter at the outlet end of said passage substantially equal to the diameter of the chain to be produced, said chain being kept within said passage by the pressure of the links against the inner wall thereof; said link take-up means in said linking position being aligned with said chain linking unit for connecting the link to the already formed chain and being adapted to partially rotate about the alignment axis while simultaneously advancing toward said passage so as to force the chain to pass therethrough, thereby causing the progressive approach of the ends of the links until said links are completely closed.

2. A machine according to claim 1, wherein said link-separation unit comprises an arm carrying said pair of blades pivotable with respect to a fixed support and means for oscillating said arm in a vertical direction between a first and a second cutting position, the amplitude of said oscillation being substantially equal to the internal diameter of said coil; and wherein said feeding unit comprises means for imparting to the coil, fed towards said link separation unit, successive, intermittent and unidirectional, 180° rotations about its longitudinal axis, said means being syncronized with said arm oscillating means so that, at the end of each 180° rotation, said pair of blades is alternately positioned in said first and said second cutting position.

3. A machine according to claim 2, wherein said means for rotating the coil comprises a shaft for frictionally dragging forward the coil and an oscillating gear sector engaging with a pinion, made integral to said shaft, when said sector moves in one direction, and idle when the same moves in the opposite direction, the displacement of said oscillating arm of said link separation unit between said cutting positions occurring simultaneously to one rotation of the coil.

4. A machine according to claim 1, wherein said calibrated passage in said chain linking unit comprises a tubular element with a progressively decreasing internal section and a bracket for supporting said tubular member, means being provided for adjusting the inclination of said bracket to put said tubular element into cooperating alignment with said take-up means when they are displaced in said linking position.

5. A machine according to claim 4, wherein said tubular element is mounted on said bracket for rotating integrally with said take-up means around the common alignment axis.

6. A machine according to claim 5, wherein said tubular element is firmly housed within a hollow shaft rotatably supported by said bracket and having a head with external axial grooves, a trailing hook projecting from said take-up means, being provided for engaging within one of said grooves when said take-up means and said tubular element is mutually aligned in the linking position.

7. A machine according to claim 6, wherein a friction ring integral with said shaft is provided, said ring resiliently urging against bracket to avoid undue rotation of said shaft.

8. A machine according to claim 6, wherein the number of grooves of said head is equal to the number of links per unit length of chain.

9. A machine according to claim 1, wherein said link take-up means comprises: a support block mounted on a horizontal fixed axis for oscillating between a take-up position and a linking position; a hollow shaft intermittently and alternately sliding within said support block, said shaft furthermore intermittently and alternatively rotating around its own axis; pincers at the end of said hollow shaft for gripping the link, operated by a tappet slidably mounted inside said hollow shaft.

10. A machine according to claim 9, wherein the angle of rotation of said hollow shaft around its own axis is equal to 360° divided by the number of links per unit length of chain.

11. A machine according to claim 4, wherein said wall of said tubular member has a negative impression of the chain to be formed therein.

* * * * *